United States Patent [19]

Nessfield

[11] Patent Number: 4,998,634

[45] Date of Patent: Mar. 12, 1991

[54] CONTAINER DOOR

[75] Inventor: Stanley Nessfield, Driffield, England

[73] Assignee: Sea Containers Ltd, London, England

[21] Appl. No.: 460,886

[22] PCT Filed: Aug. 5, 1988

[86] PCT No.: PCT/GB88/00650

§ 371 Date: Feb. 9, 1990

§ 102(e) Date: Feb. 9, 1990

[87] PCT Pub. No.: WO89/01449

PCT Pub. Date: Feb. 23, 1989

[30] Foreign Application Priority Data

Aug. 13, 1987 [GB] United Kingdom ..... 8719172

[51] Int. Cl.[5] ..... B65D 97/00

[52] U.S. Cl. ..... 220/1.5; 220/323; 220/344

[58] Field of Search ..... 220/1.5, 323, 344

[56] References Cited

U.S. PATENT DOCUMENTS 3,032,227 5/1962 Guralnick et al. ..... 220/1.5

3,891,112 6/1975 Lycett et al. ..... 220/1.5

4,057,170 11/1977 Dougherty ..... 220/1.5 X 4,212,405 7/1980 Schmidt ..... 220/1.5

FOREIGN PATENT DOCUMENTS 2467959 4/1981 France .

*Primary Examiner*—Steven M. Pollard

*Attorney, Agent, or Firm*—Ladas & Parry

[57] ABSTRACT

A door construction for a shipping container. (1) to ISO standard is provided in which there is a main frame (6) arranged to be pivotally mounted on the door frame on the container, locking means (8,9) mounted on the door (2,3) within the profile of the door so that the opposed ends of the locking means (8,9) extend beyond opposed edges of the main frame and seal means (13) extending around the edges of the main frame which are to be engaged with the container door frame for sealing the door (2,3) relative to the container (1), the seal (13) at least in the region of the locking means being offset inwardly of the locking means. The construction permits the door (2,3) and its locking members (8,9) to be within the wall profile yet maintain sealing round the door.

8 Claims, 2 Drawing Sheets

CONTAINER DOOR

This invention relates to a container door seals for containers of the type which meet ISO standard requirements and are generally of a length between 20 (6095 mm) 40 ft. (12190 mm) and 8.0 ft. (2440 mm) wide. In particular "Euro boxes" are now being employed which are 2500 mm external width and 2440 mm internal width to suit 1200 mm wide "Europallets".

Known containers are generally provided with access through doors which form the whole of one end of the container, the doors open to allow the full width of the inside of the container to be available for loading goods into the container. When the doors are closed they are sealed against the container door frame with a rubber seal which extends around the edges of the door adjacent the frame. The seal itself is of a generally U-shaped configuration in cross-section with one arm slightly longer than the other to form an overlapping type contact seal while the smaller of the arms forms a wiping type contact seal which in its sealing position is generally bent inwardly towards the longer arm whilst being in contact with the door frame of the container.

The doors are locked in the closed position by a locking bar which extends vertically on the external surface of the doors beyond the top and bottom edges of the doors so that, upon rotation of the locking bar, locking elements at the distal ends of the locking bar are moved into engagement with suitable locking means on the container frame thus drawing the door towards the door frame and assisting sealing.

When applying such containers to railway wagons there is no access to the ends of the containers and therefore the containers used on the railway wagons are provided with doors which are located in the longitudinal sides of the container and situated anywhere between the ends thereof. The doors which have been previously used at the ends of the containers have been found to be unsatisfactory for use on the longitudinal sides of the container because the locking bars extend outwardly from the side of the container thus causing an obstruction which may result in accidental damage to the locking bar and the door during transportation. It is essential that the doors be the same thickness as the walls of the container so that the inside of the doors when closed do not protrude into the loading space within the container and also that the outside of the door does not extend outwardly beyond the line of the container as set by ISO standards.

The mounting of the locking bar outside the door proves to be an unwarranted intrusion on the space within the container and restricts loading capabilities of the container. Whilst the locking bars can be mounted within the door profile the locking bar must pass through the seal around the outer edge of the door and thus effectively provides a break in the seal which reduces the effectiveness of the seal and leads to damage of goods within the container.

It is therefore desirable to provide a door for a container in which these disadvantages are substantially eliminated.

According to one aspect of the present invention there is provided a door for a container comprising two major opposed sides between which extends an outer peripheral edge surface, locking means mounted on the door within the profile of the door so that the locking means extends beyond the outer peripheral edge surface of the door and seal means located on the door for sealing the door within a door frame of the container, characterized in that the seal means extends around the outer peripheral edge surface of the door for engagement with the container door frame for sealing the door relative to the container, the seal means and locking means lying substantially in the same plane extending through the door parallel to the two major sides, and where the locking means extends beyond the outer peripheral surface the seal means is offset relative to the locking means thereby to minimize the effective door thickness.

In one embodiment of a container door according to the present invention the locking means extends vertically and the seal means extends along the top and bottom edges of the door offset inwardly along the inside of the door for engagement with the door frame of the container. Conveniently, a flange is provided along each of the top and bottom edges of the door for supporting the seal.

According to another aspect of the present invention there is provided a container for carrying cargo including a door comprising two major opposed sides between which extends an outer peripheral edge surface, locking means mounted on the door within the profile of the door so that the locking means extends beyond the outer peripheral edge surface of the door and seal means located on this door for sealing the door within a door frame of the container, characterized in that the seal means extends around the outer peripheral edge surface of the door for engagement with the container door frame for sealing the door relative to the container, the seal means and locking means lying substantially in the same plane extending through the door parallel to the two major sides and where the locking means extends beyond the outer peripheral surfaces the seal means is offset relative to the locking means thereby to minimize the effective door thickness and maximize the cargo loading area within the container.

An embodiment of the present invention will now be described by way of example with reference to the accompanying drawings, in which:

FIG 4 is a cross-sectional view of part of the top of the door illustrating the relative position of the door frame seal and container door frame elements.

Figure 1:
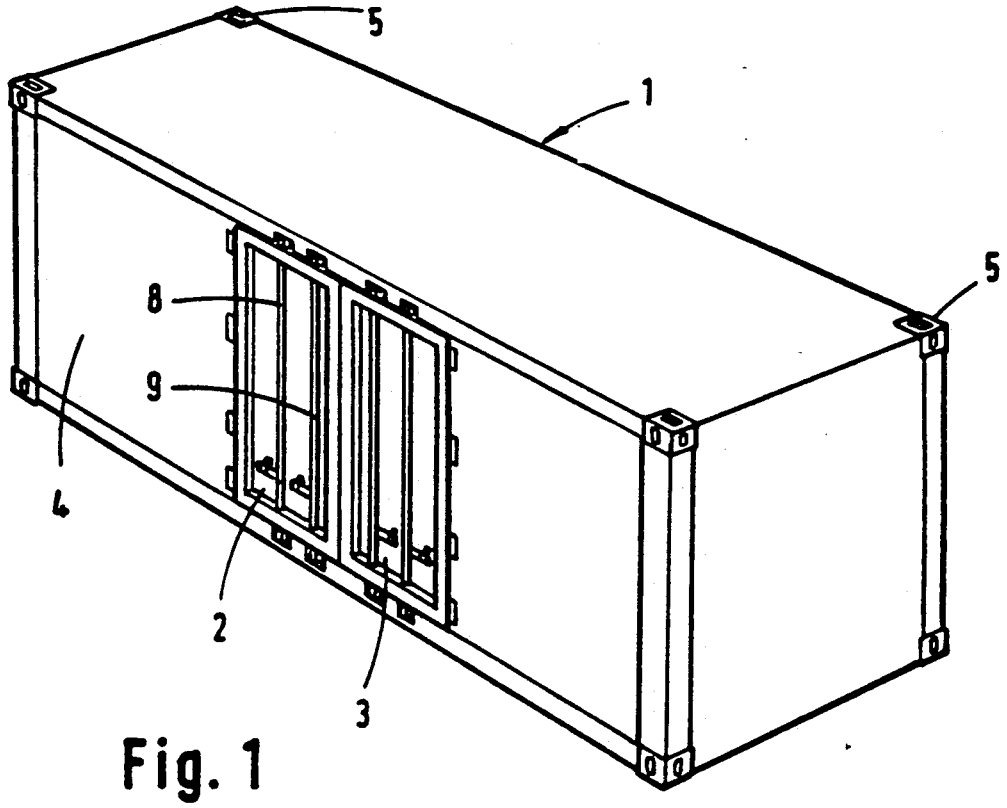
FIG. 1 is a perspective view of a container using a door according to the present invention.
Figure 2:
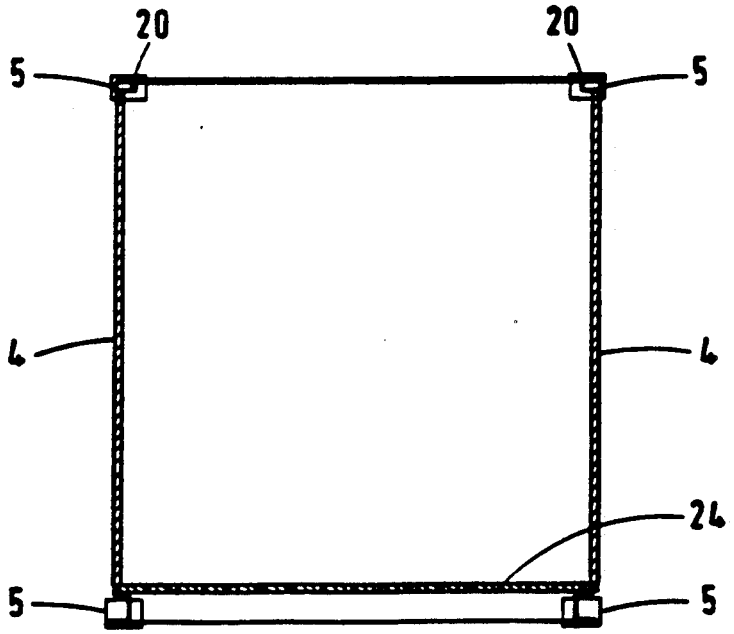
FIG. 2 is a cross-sectional view through a container with one end wall of the container removed.

To turn specifically to FIG 1 of the drawings, there is shown an ISO container 1 of a generally rectangular elongate construction being closed on all sides and having at least one pair of doors 2, 3 located substantially centrally along one side of the container 1. The container 1 is provided at each corner with standard ISO fittings 5 which enable the container to be lifted from one location on to a railway wagon for example or to be interlocked with other containers stacked one upon the other.

Figure 3:
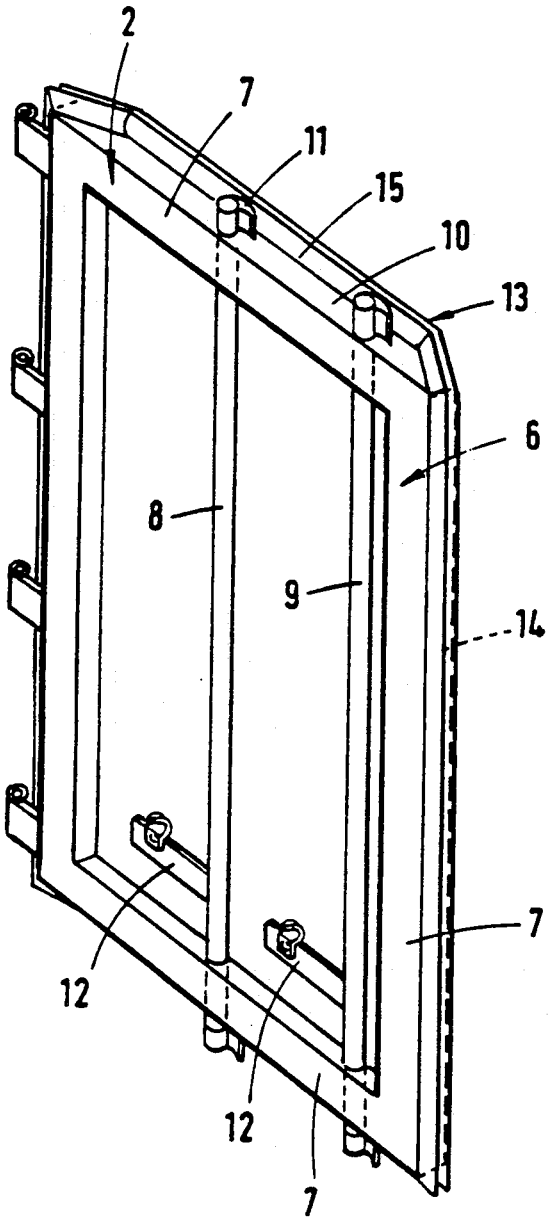
FIG. 3 is a perspective view of a container door according to the present invention.
Figure 5:
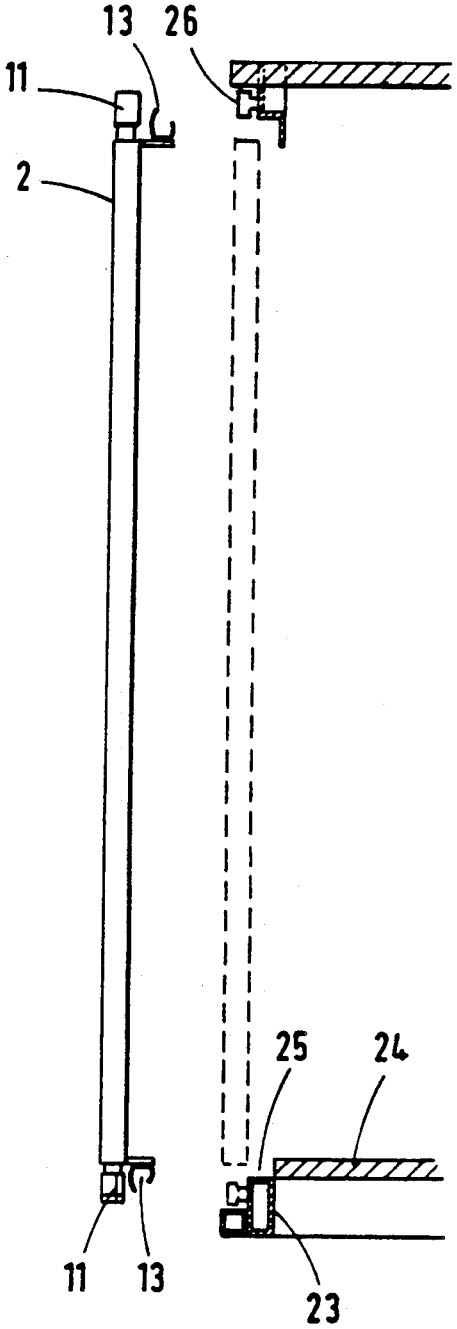
FIG 5 is a diagrammatic cross-sectional view showing the top and bottom of the container relative to the door.

The construction of one door which is to be used with the container 1 is shown in FIG. 3. The door has a rectangular main frame 6 comprising four steel elements 7 welded together at right angles to define a space therebetween which is filled, although not shown, by a corrugated element which is of the same form as the material forming the side walls of the container. The door is provided with two vertically extending locking bars of circular cross-section having distal ends extending through upper and lower frame elements 7. The portions 10 of the locking bar extending beyond the upper and lower frame elements are each provided with a hook 11 which is engagable with a cam keeper on the container to draw the door towards the container and lock the door relative to the container. The locking bars 8 and 9 are rotatably mounted in the upper and lower elements 7 and a handle 12 is provided for each locking bar to effect such rotation. The handles 12 can be locked directly to the corrugated door panel. The locking bars 8,9 are mounted in a manner and are of a diameter, which ensures the locking bars do not extend beyond the outer profile of the door. With the corrugated panel in position of the main frame of the door the locking bars are conveniently positioned in recesses of the corrugated panel.

A seal 13 of rubber or plastics material is secured along the outer surfaces 14 of the vertical side frame elements 7 whilst a portion 15 of the seal 13 extends along the top and bottom edges of the door frame located inwardly of the door frame so as to be offset from the locking bars and thus to provide a continuous seal which is not broken by the locking bars. The seal portion 15 is mounted on a flange 16 which extends inwardly of the door frame at right angles to the upper and lower frame elements 7. The seal 13 extends downwardly along the surfaces 14 substantially "in line" with, or in the same plane as, the locking bars and the side frame elements 7. Four hinges are illustrated in FIG. 3 with each hinge welded to the outer edge of the side frame element so as not to obstruct the seal running down the outer edge of the side frame element. Although not shown in FIG. 3 the seal along the bottom edge of the door is located in a similar fashion to that at the top edge of the door beneath an inwardly extending flange.

FIG 4 illustrates in more detail the general location of the seal relative to the upper door frame element 7 when the door is closed against the door frame of the container.

It is essential with such container to ensure that the loading space within the container is not obstructed and the present door construction achieves this end since there is no increase in the thickness of the door. However, to accommodate the offset seal 13 the standard top rail 20 of the container has welded thereto an additional box structure 21 only in the region of the container where the doors are located. The additional box structure 21 is provided with a recess 22 along its lower outer edge for receiving and engaging the seal 13. Therefore, in the region of the doors the additional member 21 extends downwardly from the top rail 20 by approximately 84 mm, but the obstruction formed thereby is negligible since most loading of a container does not extend to the extreme upper corners at the roof of the container.

The standard bottom rail 23 of the container which supports the floor 24 has a recess 25 formed by the flooring not extending to the extreme outer edge of the bottom rail and conveniently the seal extends into this recess. Both the top and bottom rails of the container have cam keepers 26 which are engageable by the hook 11 to draw the door towards the frame of the container and effect the sealing of the door thereto.

Accordingly, there has been described a door for a container in which the door is compact and does not protrude inside the container and also does not protrude externally of the container outside the lines laid down by the ISO standard. Furthermore, the door is no thicker than the thickness of the walls on which the door is mounted and whilst including locking bars within the profile of the door, these bards do not break the seal between the container door frame and the door when in its closed position.

I claim:

1. A door for a container, comprising two major opposed sides between which extends an outer peripheral edge surface, locking means (8, 9) mounted on the door (2, 3) within the profile of the door so that the locking means extends beyond the outer peripheral edge surface of the door and seal means (13) located on the door for sealing the door within a door frame of the container, characterized in that the seal means (13) extends around the outer peripheral edge surface of the door for engagement with the container door frame for sealing the door relative to the container, the seal means and locking means lying substantially in the same place extending through the door parallel to the two major sides and where the locking means extend beyond the outer peripheral surface the seal means is offset relative to the locking means, thereby to minimize the effective door thickness.

2. A door as claimed in claim 1, characterized in that the locking means (8, 9) extends vertically and the seal means (13) extends along top and bottom outer peripheral edge surface portions of the door and is offset inwardly towards the inside of the door for engagement with the door frame of the container.

3. A door as claimed in claim 1, characterized in a flange (16) extending inwardly of the door for supporting the seal means along each of top and bottom outer peripheral edge surface portions of the door.

4. A door as claimed in claim 1, characterized in that the locking means (8, 9) comprises one or more elongate bars (9) extending vertically of the door and projecting from top and bottom outer peripheral edge surface portions of the door.

5. A door as claimed in claim 1, characterized in that the door seal (13) is of a rubber material.

6. A door as claimed in claim 1, characterized in that the door seal (13) is of a plastics material.

7. A door as claimed in claim 1, characterized in that the door comprises a main frame (7) and a corrugated panel located therein.

8. A container for carrying cargo including a door comprising two major opposed sides between which extends an outer peripheral edge surface, locking means (8, 9) mounted on the door (2, 3) within the profile of the door so that the locking means extends beyond the outer peripheral edge surface of the door and seal means located on this door for sealing the door within a door frame of the container, characterized in that the seal means (13) extends around the outer peripheral edge surface of the door for engagement with the container door frame for sealing the door relative to the container, the seal means and locking means lying substantially in the same plane extending through the door parallel to the two major sides and where the locking means extends beyond the outer peripheral surface the seal means is offset relative to the locking means thereby to minimize the effective door thickness and maximize the cargo loading area within the container.

* * * * *